US005358189A

United States Patent [19]

Vandermolen

[11] Patent Number: 5,358,189

[45] Date of Patent: Oct. 25, 1994

[54] PROCESSOR FOR CHIPPING AND SHREDDING VEGETATION

[76] Inventor: Aldo Vandermolen, 16 Welsh Rd., Essex Fells, N.J. 07021

[21] Appl. No.: 128,870

[22] Filed: Sep. 29, 1993

[51] Int. Cl.[5] ..... B02C 13/04; B02C 21/02

[52] U.S. Cl. ..... 241/92; 241/101.7; 241/154; 241/194

[58] Field of Search ..... 241/92, 154, 189.1, 241/194, 101.7

[56] References Cited

U.S. PATENT DOCUMENTS

| | | | |
|---|---|---|---|
| 2,361,278 | 10/1944 | Evans | 83/11 |
| 2,856,134 | 10/1958 | Tormey | 241/186 |
| 3,276,700 | 10/1966 | Eklund | 241/55 |
| 3,756,517 | 9/1973 | Hoch et al. | 241/56 |
| 3,917,176 | 11/1975 | Carlsmith | 241/55 |
| 4,824,034 | 4/1989 | Baker | 241/101.2 |
| 4,834,302 | 5/1989 | Baker | 241/92 |
| 4,860,961 | 8/1989 | Hilgarth | 241/92 |
| 4,951,882 | 8/1990 | Ober | 241/55 |
| 5,018,672 | 5/1991 | Peck et al. | 241/37.5 |
| 5,102,056 | 4/1992 | Ober | 241/55 |
| 5,240,189 | 8/1993 | Majkrzak et al. | 241/55 |
| 5,240,190 | 8/1993 | Johnson | 241/74 |
| 5,279,467 | 1/1994 | Lydy | 241/101.7 |

*Primary Examiner*—Mark Rosenbaum
*Assistant Examiner*—John M. Husar
*Attorney, Agent, or Firm*—Thomas L. Adams

[57] ABSTRACT

A processor can chip and shred vegetation including wood and one or more of various other materials such as agricultural products, yard and garden debris, or forestry brush and waste. This processor has a housing with a hopper opening. Also included is a rotor that is rotatably mounted in the housing and has a non-uniform radial dimension. The processor has a drive means that is adapted to drive the rotor. A cutter is mounted on the rotor to swing past the hopper opening. A hopper is mounted at the hopper opening on the housing for feeding the material toward and past the cutter. The processor also has at least one flail mounted alongside the rotor to rotate relative thereto in a full circle. The flails interdigitate with the fixed cutter mounted on the inside of the rotor housing at the periphery of the rotor.

22 Claims, 3 Drawing Sheets

PROCESSOR FOR CHIPPING AND SHREDDING VEGETATION

BACKGROUND OF THE INVENTION

1. Field of the Invention

The present invention relates to processors for chipping and shredding vegetation and, in particular, to machines having cutters mounted on a rotor.

2. Description of Related Art

Known chippers have employed a relatively heavy, steel disk mounted in a cylindrical housing. The disk has slots where cutting blades are mounted. The disk housing has a hopper for feeding branches and limbs through the side of a housing and into the spinning cutter blades. A cutter bed bar can be mounted in the cylindrical housing to subjacently support the lower edge of the hopper opening and provide a firm platform to hold the material against the action of the cutter blades. These known chippers can be driven by a gasoline engine or by a drive shaft adapted to be connected to the drive train of a tractor or other machine.

In some embodiments, the rating of the chipper is determined by the angular momentum stored in the chipper rotor. Such designs anticipate spinning a relatively heavy rotor at a high speed. Consequently, wood fed into the chipper blades would tend to slow the rotor but not unacceptably so if the wood is of a rated size.

An advantage with this type of design is the fact that the motor or drive shaft spinning the chipper rotor need not have the horsepower needed to supply all of the power required when the chipping is actually occurring. Instead, the motor can store kinetic energy in the rotor using a flywheel effect, so that energy can be withdrawn quickly during chipping without excessively loading the motor.

A conventional shredder can employ a plurality of coaxial disks mounted inside a cylindrical housing. Swinging bars or flails can be mounted between the coaxial disks to articulate and assist in the shredding process. While material to be chipped is brought to the side of a rotating disk, material to be shred conventionally is fed radially into the spaces between the rotating disks.

Chippers and shredders are often used by landscapers, farmers, foresters or others who must reduce various types of materials. For this reason, combined chipper/shredders have been designed. Such combined chipper/shredders have employed two hoppers, one to feed shreddable material radially between coaxial disks and another hopper to feed chippable material to the side of an outer disk carrying chipper blades.

A combined chipper/shredder is disclosed in U.S. patent application 08/000,621, filed Jan. 5, 1993 and entitled Processor for Chipping and Shredding Vegetation. The disclosure of that application is incorporated herein by reference. This processor was designed to have a close fit between the processor housing and the rotor carrying the cutter blades. The close fit ensured that the processor worked efficiently and material fed into the hopper did not bypass the rotor. Were a loose fit employed, twigs could be thrown centrifugally into the space between the housing and the rotor where they could either bypass the rotor or accumulate to cause binding of the rotor. While keeping a small rotor to housing spacing is workable, using looser tolerances are preferable.

Also in this same machine, the illustrated flails are mounted in four quadrants between four equiangularly spaced vanes. The flails can recoil upon encountering heavy material or striking debris built up on the inside of the housing. A recoiling flail can hit a neighboring vane, causing wear and potential damage. In addition, the flails can swing backwards when accelerating at start up or forwards when decelerating at shut off. Such swinging can also cause the flails to swing and hit the vanes.

U.S. Pat. No. 3,276,700 shows a wood chipper employing a rotary disk with angularly spaced knives and passageways. Material is fed to one side of the disk and chips pass through the other side while air is continuously circulated throughout the housing.

U.S. Pat. No. 3,756,517 shows a forage blower with a recutter. Material is transferred from the cutter to the impeller in the direction of rotation of the impeller. Therefore, the exit velocity of the material has a significant component towards the discharge opening. This assembly includes a perforated cylindrical screen or cage. Material passing through the cage is thrown into impeller paddles which sweep the recut materials into an outlet. See also U.S. Pat. Nos. 2,361,278; 3,276,700; 3,917,176; 4,951,882.

SUMMARY OF THE INVENTION

In accordance with the illustrative embodiments demonstrating features and advantages of the present invention, there is provided a processor can chip and shred vegetation including wood and one or more of various other materials such as agricultural products, yard and garden debris, or forestry brush and waste. This processor has a housing with a hopper opening. Also included is a rotor that is rotatably mounted in the housing. The processor has a drive means that is adapted to drive the rotor. A cutter is mounted on the rotor to swing past the hopper opening. A hopper is mounted at the hopper opening on the housing for feeding the material toward and past the cutter. The processor also has at least one flail mounted alongside the rotor to rotate relative thereto in a full circle.

A related embodiment of the same invention does not necessarily have the above flail. This embodiment does have the housing, drive means, cutter, hopper, and rotor. The rotor is rotatably mounted in the housing and has a non-uniform radial dimension.

BRIEF DESCRIPTION OF THE DRAWINGS

The above brief description as well as other objects, features and advantages of the present invention will be more fully appreciated by reference to the following detailed description of presently preferred but nonetheless illustrative embodiments, when taken in conjunction with the accompanying drawings, wherein.

DETAILED DESCRIPTION OF THE PREFERRED EMBODIMENTS

Figure 1:
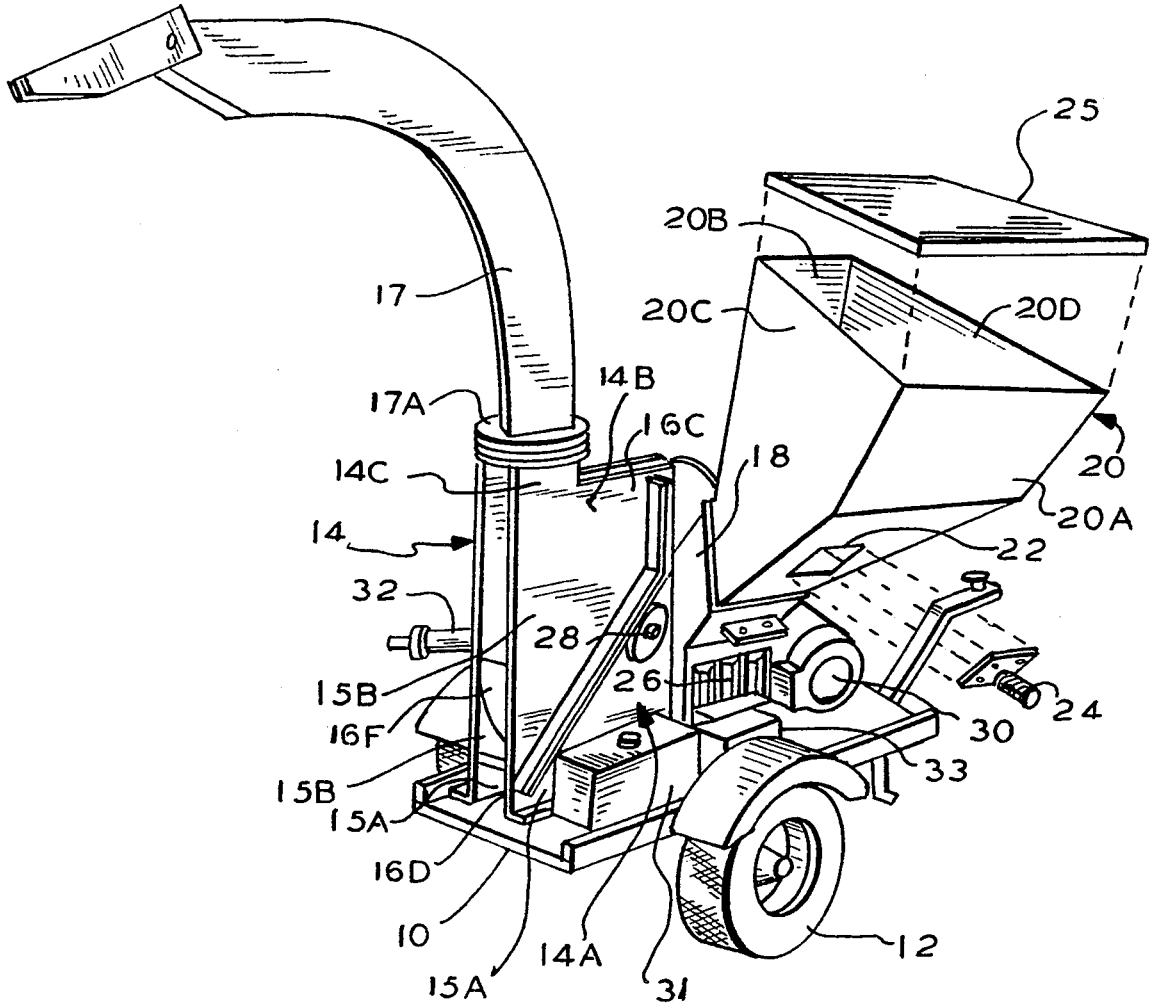
FIG. 1 is an axonometric view of a processor in accordance with the principles of the present invention.
Figure 3:
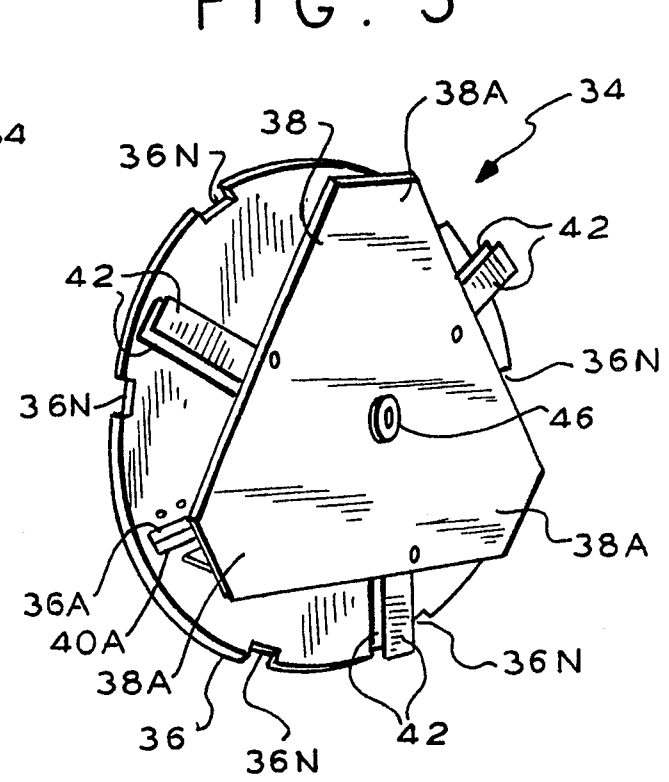
FIG. 3 is a reverse view of the rotor of FIG. 2.
Figure 2:
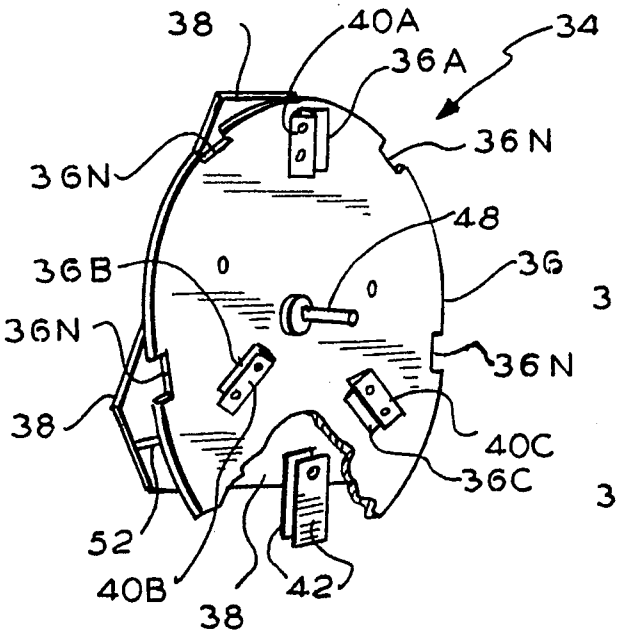
FIG. 2 is an axonometric view of the rotor, with a portion broken away for illustrative purposes, which is mounted inside the processor of FIG. 1.

Referring to FIG. 1, a processor is shown mounted on a cart comprising a platform 10 supported by a pair of wheels 12. Housing 14 is shown as a cylindrical casing comprising a pie shaped, lower shell 14A and a larger, complementary, upper shell 14B. Shells 14A and 14B are hinged at their lower left corners (this view). As described further hereinafter, shells 14A and 14B are each essentially a pair of parallel steel plates between which are mounted cylindrically curved plates.

Shells 14A and 14B meet at an angled seam bordered by flanges 16C. The vertical section of flange 16C is oriented to accommodate in shell 16B a relatively large area for hopper throat 18. Hopper throat 18 is part of hopper 20, which includes a funnelling chute having a front wall 20A, rear wall 20B and two side walls 20C and 20D. Front wall 20A is much wider than rear wall 20B to facilitate the loading of material into hopper 20. Also, front wall 20A has an upper face steeper than its lower face to keep materials from spilling from hopper 20. Welded to the side of shell 14A below hopper throat 18 are four parallel reinforcing ribs to support a cutter bar to be described presently.

The lower face of front wall 20A has a vacuum port 22 in the form of a square opening. Port 22 can either be covered with a plate or be connected to the flange of a vacuum hose accessory 24. As described hereinafter, the processor creates a vacuum which allows hose 24 to suck debris at a distance from the processor. When vacuum accessory 24 is used, cover 25 is fitted atop hopper 20 to ensure a high vacuum.

Housing 14 has an outlet conduit 14C which extends tangentially and vertically from the side of the housing 14. Outlet 14C is fitted with an outlet pipe 17 for throwing the shredded and chipped debris to a selected location such as a truck, cart or compost pile. Pipe 17 can swivel azimuthally, and is connected to outlet conduit 14C by a split ring shaped as the outer half of a toroid. Fitting 17 can be tightened by a bolt (not shown) spanning the split ends of the fitting.

In other embodiments, housing 14 can have a different shape and may be mounted horizontally instead. Also, the two shells can meet at different joints, at different angles, along curves, or otherwise. Also in some embodiments the housing will not employ shells that swing open; instead, access plates may be used to service the inside of the housing, while more involved servicing may require disassembling the entire housing.

A rotor (described hereinafter) is mounted inside housing 14 on bearing 28. The rotor is driven by a drive means, shown herein as gasoline motor 30. Motor 30 has an output shaft which drives a number of belts (not shown) that rotate the rotor around the bearing 28. A gas tank 31 and battery 33 may be mounted on platform 10 to support motor 30. In this embodiment, motor 30 is rated at 18 horsepower, but this rating can change depending upon the desired capacity of the processor.

In some embodiments, a self-contained motor is not employed and a separate drive shaft 32 can be connected through pulleys, belts or gearboxes directly to the axle of the rotor. Drive shaft 32 can be connected to the option driver of a tractor or other vehicle having the ability to drive an external accessory. Shaft 32 may employ a shear bolt (not shown) to disconnect the shaft should it bear an excessive load.

Referring to FIGS. 1–7, previously mentioned shell 14A is shown comprising a pair of steel, polygonal, support plates 15A each forming an obtuse angle that mates with the complementary acute angle in the two support plates 15B. Cylindrical side wall 16G is shown extending (FIG. 6) about 220° in a circular arc around support plate 15A. Shell 14B has a corresponding support plate 15B and a spaced pair of cylindrical wall segments 16F abutting cylindrical wall 16G.

The inside and outside walls of outlet conduit 14C are shown (FIG. 6) as a pair of parallel plates 16E of different lengths that straddle plates 15B and abut the inside ends of cylindrical wall segments 16F. Walls 16E, 16F, and 16G are steel and are welded between the support plates 15A and 15B.

Figure 6:
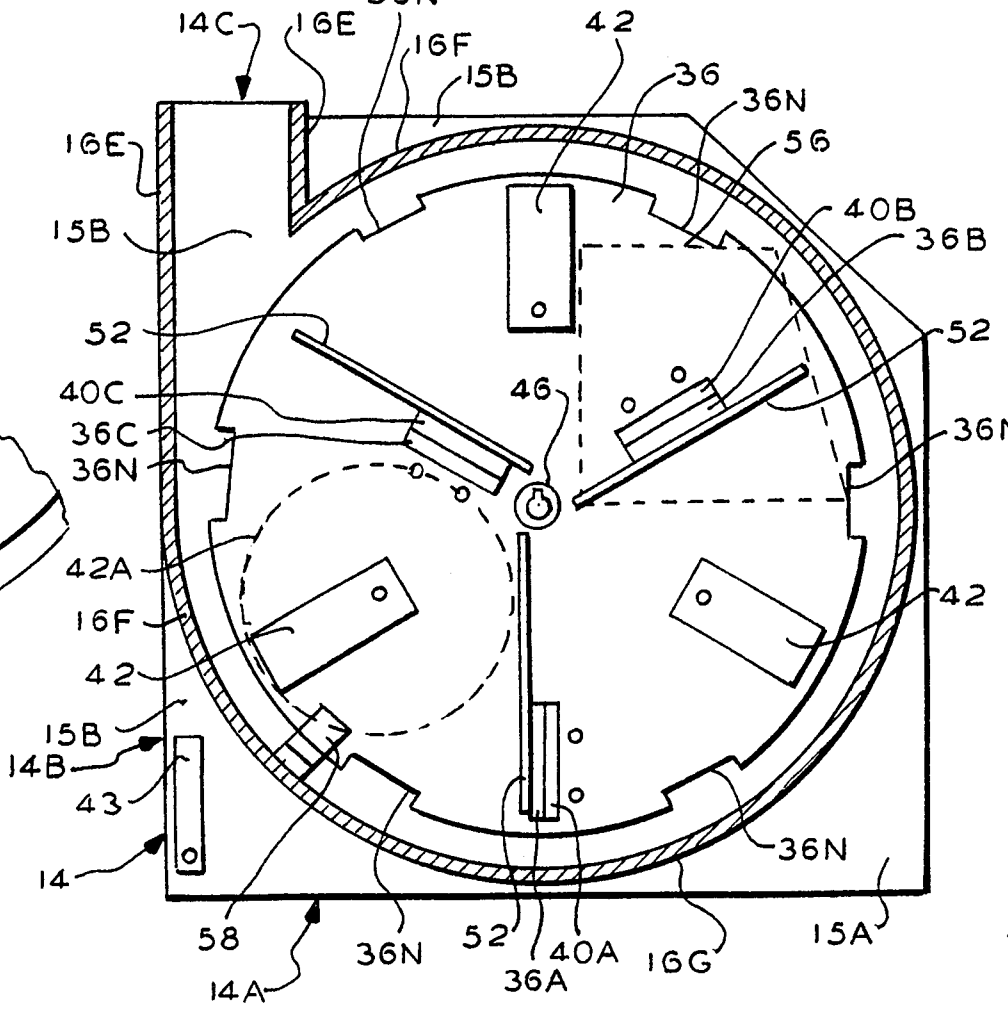
FIG. 6 is a side view taken along line 6—6 of FIG. 5 and showing the rotor and parts of the housing.

Shells 14A and 14B can swing apart and are hinged at the lower left corners (FIG. 6). A hinge plate 43 is shown welded to support plate 15B and pivotally connected to support plate 15A. This allows plate 15B to pivot away from plate 15A and provide access to the rotor and its components.

Rotor 34 is shown as a pair of disks 36 and 38. The space between disks 36 and 38 is about 3.5 inches, although this dimension will vary depending upon the capacity of the processor. In some embodiments, only one disk will be employed and the housing itself will act as a barrier to contain the material being shredded. The clearance between the housing and disks 36 and 38 is kept small to avoid material bypassing the disks. The clearance can be ½ inch, although this clearance will vary in different embodiments.

Disk 36 has a primarily circular periphery but with a plurality of notches 36N that act as a serrated edge to make a non-uniform radial dimension. While six equiangularly spaced slots are illustrated, a different number may be used in alternate embodiments. Preferably, at least one notch will be placed between each pair of vanes. The preferred notch is 2 inches by ½ inch although these dimensions can be changed for alternate embodiments. As described hereinafter in further detail, these notches are used to clear and help process debris that may become lodged between the disk 36 and the housing walls 16F and 16G.

Instead of notches the periphery of disk 36 may contain sawteeth having a triangular, arcuate, circular or other shape. Alternatively, the periphery may be undulating or sinusoidal. In some embodiments the periphery may have projections that are welded, bolted or fastened to disk 36.

Disk 38 is shown as a polygon having three apices 38A. Disk 38 may be viewed as a triangle with its corners cut off. Disk 38 could be circular instead, but the illustrated shape has the advantage of being lightweight.

Mounted on disk 36 at right angles to each other are three cutters or blades 40A, 40B and 40C. These blades are each mounted at radially different positions. Thus the blades sweep three contiguous, annular areas. The blades 40A, 40B and 40C are bolted on disk 36 to project over radially extending slots 36A, 36B and 36 from their trailing edges. These slots are each 5.0 inches long and 1.62 inches wide, although these dimensions can vary depending on the size and capacity of the machine.

Figure 7:
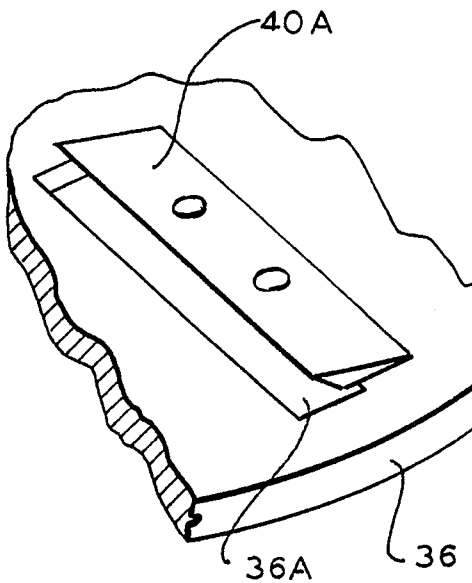
FIG. 7 is a detailed axonometric view of one of the cutter blades on the rotor of FIG. 2.

As shown in FIG. 7, cutter blades 40A (and blades 40B and 40C as well) are quadrilateral prisms made of A8 modified steel. The cutting edge is acute and its underside is relieved to direct chipped material into slot 36A.

Disks 36 and 38 are $\frac{5}{8}$ and $\frac{1}{4}$ inch thick, respectively and both are 29 inches in diameter. Disks 36 and 38 are preferably made of A36 hot rolled steel. It will be appreciated, that the size, weight and composition of the disks can be altered depending upon the capacity of the machine. In particular, disks 36 and 38 are designed to be rotated at an unloaded speed of 2250 RPM to store a predetermined amount of angular momentum. As explained before, a heavier wheel can store more angular momentum and therefore have a higher rating for chipping wood.

Three pairs of flails 42 are mounted to articulate between disks 36 and 38. Flails 42 are long rectangular bars that are connected together in pairs near their outer ends and are pivotally connected between the disks at three equiangularly spaced positions. The inner ends of each pair of flails 42 are bolted between disks 36 and 38 and positioned with spacers 44 located between and on the outer sides of the flails.

Flails 42 are shown $7\frac{3}{4}$ inches long and 3 inches wide and have a 1 inch space between them in this embodiment, but they can be dimensioned differently in alternate embodiments. While the flails are shown as elongate plates, in other embodiments they may be more (or less) numerous, shorter plates mounted at radially spaced positions. In other embodiments, the flails need not be rectangular but can be triangular, polygonal, round or have other shapes.

Disks 36 and 38 are coaxially welded to a keyed central hub 46, sized to receive a keyed shaft 48 (which is mounted inside bearing 28 of FIG. 1). Shaft 48 is shown attached to the drive pulleys 50, which are used by the previously mentioned motor to spin rotor 34.

Welded between disks 36 and 38 are three impeller blades 52. It will be appreciated that a different number of blades can be used and that these blades need not be straight radial plates but can be repositioned and curved to produce certain desired effects. Also, while vanes 52 are shown radially smaller than the disks, in other embodiments they can be of the same radial length (provided clearance exists).

Significantly flails 42 are positioned and sized to rotate in a full circle, e.g. circle 42A. Flails 42 can so rotate without hitting vanes 52 and without axially overlapping blades 40A, 40B and 40C.

Figure 5:
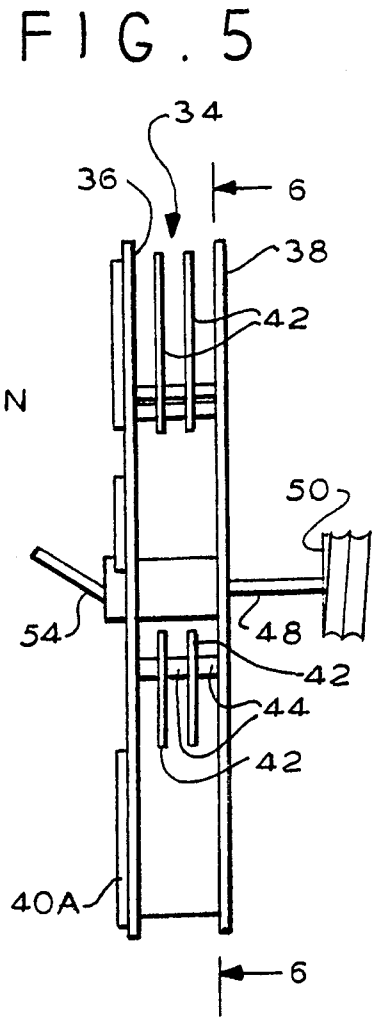
FIG. 5 is an edge view of the rotor of FIG. 2.

A stationary cutter bar 54 (sometimes referred to as a bed bar) is shown mounted in FIG. 5 at about a 45° angle to interact with cutter blades 40A 40B and 40C. Bar 54 is vertically reinforced by previously mentioned ribs (ribs 26 of FIG. 1). Bar 54 is at the lower edge of hopper opening 56, shown in phantom in FIG. 6 as a trapezoidal hole in the side of the support plate (the support plate 15A having the hopper opening is not visible in FIG. 6 but is visible in the other Figures). The outer edge of hopper opening 56 is at about 60° to the lower edge, while the inside edge is vertical and the upper edge horizontal.

As discussed previously, hopper opening 56 can take alternate shapes, but is preferably relatively large without having an unduly complex shape. In this embodiment a four sided opening makes fabrication of the hopper relatively simple, although in some embodiments the hopper opening may be more generally polygonal, curved, or shaped otherwise.

A trio of fixed cutter teeth 58 are mounted at the lower end of cylindrical wall 16G to interdigitate with the passing flails 42. While the teeth preferably outnumber the passing flails by one, in some embodiments a single tooth can be used to pass between the two flails 42. Teeth 58 can be used to chop, break up and reduce in size material thrust into the teeth by flails 42. This feature greatly aids the overall objective of processing material. The teeth 58 are used to dislodge debris that may become lodged between the flails 42. Teeth 58 are about 2 inches tall, 2 inches wide and $\frac{1}{4}$ inch thick and are welded to a base plate 60. In other embodiments, the teeth can have different dimensions and may be triangular, polygonal or have rounded corners or beveled edges.

To facilitate an understanding of the principles associated with the foregoing apparatus, the operation of the apparatus of FIGS. 1–7 will be briefly described. Motor 30 can be started or power can be supplied through an optional drive shaft 32 (FIG. 1). Normally, in embodiments where drive shaft 32 is employed, no motor is provided and drive shaft 32 connects to support shaft 48 through pulleys, belts and gear boxes.

Figure 4:
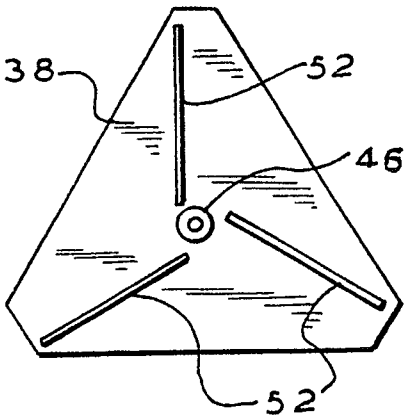
FIG. 4 is an inside view of the disk mounted on the rotor of FIG. 2.

Once started, motor 30 spins rotor 34 to about 2,250 RPM, although others angular velocities are contemplated. Once the rated speed is achieved, an operator can place a limb into hopper 20. A relatively thick limb will not, by design, fill the entire hopper opening 56 (FIG. 4). The limb will rest initially on the upper surface of stationary cutter bar 54 which together with reinforcing ribs 26 support the limb against the action of cutter blades 40A, 40B and 40C. Cutter blades 40A and 40B will progressively chip the limb and the chips will pass through slots 36A, 36B and 36C into the space between disks 36 and 38. The chips will also be drawn in by the vacuum created by impeller vanes 52, which centrifugally impel air through outlet 14C.

Chips located between disks 36 and 38 will tend to travel through a relatively short path from approximately the 3 o'clock to the 9 o'clock position where they will then discharge through outlet path 14C into pipe 17. Some chips however will not immediately exit and will circulate one or more times inside the processor before being discharged.

In a realistic working environment, the limb may not be carefully trimmed and may include smaller branches, twigs and leaves. The relatively large hopper opening 56 can accept this smaller material. Smaller material such as leaves may pass through the cutter blades without being sufficiently mulched. For this purpose, flails 42 tend to further beat and disintegrate the material. The smaller material is lighter and may tend to circulate longer inside the processor. Nevertheless, the bulk of the material will again pass through the processor within one cycle. The flails 47 interdigitate with teeth 58 to break up and reduce in size this material. Thus teeth 58 greatly enhance the processing efficiency.

In some cases agricultural waste products or yard debris such as leaves must be processed. That material may be loaded directly into hopper 20 or, if light, sucked through vacuum hose 24 (in which case cover 25 will be placed over hopper 20). In either event, hopper 20 faces upward and has a large volume for accepting debris. Hopper opening 56 has a large size for high volume processing because the opening is not constrained to a square outline simply to accommodate a large limb.

Especially when leaves, hedge clippings, vines and similar material are being processed, flails 42 may become clogged with debris. For this purpose, teeth 58 interdigitate with the flails 42 to clear them and to further reduce the size of the debris.

Because of the highly efficient arrangement where all material is initially subjected to a chipper blade, the material can pass through the processor quickly. Furthermore, the material does not need to be confined for additional cycles within the processor by using an outlet screen, as has been typical of the prior art. Because the material is processed so quickly, such a screen is unnecessary.

Significantly flails 42 are positioned and sized to rotate in a full circle, e.g. circle 42A. Flails 42 can so rotate without hitting vanes 52 and without axially overlapping blades 40A, 40B and 40C. This freedom of movement is important when the flails recoil upon encountering heavy material or striking debris built up on the inside of the housing. The recoiling flail will not hit a neighboring vane, thereby avoiding wear and potential damage. In addition, the flails can swing backwards when accelerating at start up or forwards when decelerating at shut off. Such swinging can occur without the flails swinging and hitting the vanes.

This processor was designed to have a close fit between the processor housing 14 and the rotor 36 carrying the cutter blades. This close fit promotes efficiency and avoids material fed into the processor from bypassing rotor 36. Nevertheless, the tolerance is not zero and certain size twigs can be thrown centrifugally into the space between the housing 14 and the rotor 36 where they could either bypass the rotor 36 or accumulate to cause binding of the rotor.

Notches 36N on rotor 36 tend to drag the material lodged at the periphery of rotor 36 into the teeth 58. At this point the peripheral material is broken up sufficiently so that bypassing rotor 36 does not cause problems. Because notches 36N efficiently and quickly break up peripheral material, the required tolerance for is eased for the fit between rotor 36 and housing 14.

It is to be appreciated that various modifications may be implemented with respect to the above described preferred embodiments. For example, in some embodiments the rotor notches can be changed to saw teeth having a triangular or other outline. Also, the size of the processor can be altered depending upon the desired capacity. Also the size, shape and orientation of the hopper can be altered for similar reasons. While most of the components described herein are made of welded plate steel, in other embodiments plastics, different metals and other materials can be employed instead. Furthermore various types of drive means are contemplated, including electric motors, gas turbines, PTO shafts, etc. Additionally, the number and placement of the cutter blades and the flails can be altered depending upon the processing capacity. Moreover, the vacuum accessory can be attached at a number of different points from which a vacuum can be drawn, besides those positions already illustrated.

Obviously many modifications and variations of the present invention are possible in light of the above teachings. It is therefore to be understood that within the scope of the appended claims, the invention may be practiced otherwise than as specifically described.

I claim:

1. A processor for chipping and shredding vegetation including wood and at least one other material selected from the group consisting of agricultural products, yard and garden debris, and forestry brush and waste, said processor comprising:

a housing having a hopper opening;

a rotor rotatably mounted in said housing;

a drive means adapted to drive said rotor;

a cutter mounted on said rotor to swing past said hopper opening;

a hopper mounted at said hopper opening on said housing for feeding said material toward and past said cutter;

an angularly spaced plurality of flails mounted alongside said rotor to rotate relative thereto in a full circle; and a plurality of radially extending impeller vanes mounted at angularly spaced positions on said rotor between said flails, said flails being sized and positioned to rotate without touching said vanes.

2. A processor according to claim 1 wherein said rotor has a non-uniform radial dimension.

3. A processor according to claim 2 wherein said rotor has a serrated edge.

4. A processor according to claim 3 wherein said rotor is fitted in said housing to avoid material peripherally bypassing said rotor, said serrated edge having a plurality of notches.

5. A processor according to claim 1 wherein said flail is positioned and sized to rotate in a full circle without axially overlapping said cutter.

6. A processor according to claim 1 wherein said cutter comprises:

a plurality of angularly spaced blades, each mounted between different corresponding pairs of said flails, at radially spaced positions on said rotor to sweep different corresponding areas, said flails being sized and positioned to rotate without axially overlapping any of said blades.

7. A processor according to claim 1 wherein said cutter comprises:

a plurality of blades mounted adjacent different corresponding ones of said vanes at angularly and radially spaced positions on said rotor to sweep different corresponding areas, said flails being sized and positioned to rotate without axially overlapping any of said blades.

8. A processor according to claim 7 wherein said flails are three in number.

9. A processor according to claim 8 wherein said vanes and blades are each three in number.

10. A processor according to claim 1 wherein said rotor has an edge with a plurality of spaced notches, said notches being at least as numerous as said flails.

11. A processor according to claim 10 wherein each of said flails comprises:

a pair of parallel bars.

12. A processor according to claim 1 comprising:

at least one fixed cutter tooth circumferentially mounted on said housing to interdigitate with and clear debris from said flails and further reduce debris in size.

13. A processor according to claim 1 wherein said flails each comprise:

a pair of parallel bars mounted to articulate on a face of said rotor opposite said hopper opening; and a trio of fixed cutter teeth circumferentially mounted on said housing to interdigitate with said flails to reduce debris in size and to clear debris from said flails.

14. A processor according to claim 1 wherein said rotor has a radial slot adjacent to said blade for passing its cuttings.

15. A processor according to claim 1 wherein said processor is structured to process wood having a rated maximum diameter, said hopper opening being sized to accept at least one other material in amounts exceeding said rated maximum diameter.

16. A processor according to claim 1 comprising: a disk parallel and attached to said rotor, said vanes and said flails being mounted between said disk and said rotor.

17. A processor according to claim 16 wherein said disk has a plurality of apices, said vanes being mounted in alignment with said apices.

18. A processor for chipping and shredding vegetation including wood and at least one other material selected from the group consisting of agricultural products, yard and garden debris, and forestry brush and waste, said processor comprising:

a housing having a hopper opening;

a rotor having a unitary, plate-shaped disc rotatably mounted in said housing, said disc having a non-uniform radial dimension providing a non-uniform edge shaped to dislodge material lodged between said non-uniform edge and said housing, said disc having a cutter aperture positioned coplanar with said non-uniform edge;

a drive means adapted to drive said rotor;

a cutter mounted on said disc at said cutter aperture to swing past said hopper opening; and a hopper mounted at said hopper opening on said housing for feeding said material toward and past said cutter.

19. A processor according to claim 18 wherein said rotor has a serrated edge.

20. A processor according to claim 19 wherein said rotor is fitted in said housing to avoid material peripherally bypassing said rotor.

21. A processor according to claim 18 wherein said rotor has a serrated edge having a plurality of notches.

22. A processor according to claim 21 wherein said rotor is fitted in said housing to avoid material peripherally bypassing said rotor.

* * * * *